US005722281A

United States Patent [19]

Yasuda et al.

[11] Patent Number: 5,722,281

[45] Date of Patent: Mar. 3, 1998

[54] APPARATUS FOR MANUFACTURING AN AUTOMOTIVE STEERING RACK

[75] Inventors: Tsutomu Yasuda; Jun Minamoto, both of Saitama, Japan

[73] Assignee: Showa Corporation, Gyoda, Japan

[21] Appl. No.: 571,409

[22] Filed: Dec. 13, 1995

[30] Foreign Application Priority Data

Dec. 27, 1994 [JP] Japan ..... 6-337053

[51] Int. Cl.[6] ..... B21B 15/00; B21B 17/10; B21B 17/02

[52] U.S. Cl. ..... 72/207; 72/208; 72/192; 72/367; 72/370

[58] Field of Search ..... 72/207, 208, 367, 72/370, 192, 220, 88, 469, 893.34

[56] References Cited

FOREIGN PATENT DOCUMENTS 58-31257 7/1983 Japan .

35892 1/1991 Japan .

*Primary Examiner*—Lowell A. Larson

*Assistant Examiner*—Rodney A. Butler

*Attorney, Agent, or Firm*—Dvorak & Orum

[57] ABSTRACT

An automobile steering rack manufacturing apparatus has a material clamp for holding a hollow pipe-like rack material that has a solid core bar inserted therein. A forming roll on the apparatus has an outer periphery with rack teeth formed thereon, while a material drive causes a mutual rolling of the material clamp and the forming roll, thereby cutting rack teeth into the material. The clamp moves in the tangential direction of the forming roll orientation, and a tooth depth controller controls the distance between the rack material held in the material clamp, and the forming roll.

2 Claims, 8 Drawing Sheets

APPARATUS FOR MANUFACTURING AN AUTOMOTIVE STEERING RACK

BACKGROUND OF THE INVENTION

1. Field of the Invention

The present invention relates to an apparatus for manufacturing an automotive steering rack by forming a side surface of a hollow, pile-like material with rack teeth.

2. Description of the Background Art

A usual rack used for an automotive steering mechanism or the like is manufactured from a round bar by flattening a portion of the outer periphery of the bar and then forming rack teeth on the flattened portion. As the preferred rack material, a hollow pipe is used in order to satisfy a light weight demand.

Japanese Patent Publication (JP-B 2) No. Sho 58-31257/1983 shows a method of forming rack teeth by plastically processing a rack material. In this method, a rack teeth formation portion of the material is pressed in a direction perpendicular to the axis of the material with an upper die having a tooth form which is complementary to the rack teeth.

Japanese Patent Publication (JP-B2) No. Hei 3-5892/1991 shows a method of forming a train of teeth on a flat portion of a hollow pipe-like rack material, by applying a forming die which has the same concavity and convexity as the rack teeth on the flat portion and then pressure fitting a punch into the hollow of the pipe. The flat portion of the material is forced into the concavity and convexity of the forming die.

However, both of these prior art techniques involve the preliminary step of forming a side rack teeth formation portion on a pipe which has a flat surface. This is undesired from the standpoint of productivity. In addition, the forming process requires a high pressing force (i.e., a high pressing pressure), wherein burrs are readily formed around the newly formed rack teeth.

SUMMARY OF THE INVENTION

An object of the invention is to provide an apparatus for rack manufacture, which simplifies the rack teeth forming process. It is another object of the invention to form rack teeth with comparatively low forces and with less burr generation.

According to the invention, there is provided an apparatus which is comprised of a rack material holding means for holding a hollow pipe-like rack material having a core bar inserted therein, a forming roll having an outer periphery thereof formed with a rack teeth form, a mutual moving means for causing mutual moving of the rack material holding means and the forming roll against each other in a tangential direction to the orientation of the forming roll, and a feeding means for adjusting the distance between the rack material held by the rack material holding means and the forming roll. The rack material holding means includes an angle adjusting means for varying the holding angle of the rack material against the forming roll.

The rack material holding means can also hold two rack materials in face-to-face relationship on diametrically opposed sides of the forming roll, wherein the mutual moving means causes movement of the individual rack materials in opposite directions.

Since the forming roll is pressed against each of the rack materials and the rack material is caused to move over the forming roll in a tangential direction to the orientation of the forming roll, the roll is rotated by the tangential forces caused while wedging the rack material against form of the rack teeth in the forming roll.

The present invention eliminates the need of first forming a flat surface on the material where the rack teeth will be formed, making it possible to form rack teeth directly in the round pipe. The process is thus simplified, thereby improving productivity.

Also, the inter-axis distance between the forming roll and rack material can be reduced by a feeding means for every predetermined number of cycles (for instance every cycle) of mutual rolling of the forming roll and the rack material. Thus, the forming roll incrementally wedges itself into the material every predetermined number of cycles, making it possible to form rack teeth without requiring high forces at each pass, rather, comparatively low forces can be used. Advantageously, this means the rack teeth can be formed free of burrs, and thus, it is possible to form rack teeth having excellent mechanical strength.

An angle adjusting means for varying the holding angle of the rack material to the forming roll means that the rack material can be provided with rack teeth at right angles to the axial direction of the rack material, or they may also be readily provided with rack teeth at an angle to the axial direction of the rack material.

By holding two rack materials such that they face each other on diametrically opposed sides of the forming roll while moving both of the rack materials in opposite directions, the contact forces exerted by the rack materials on the forming roll cancel each other along each point of symmetry along the roll axis. Thus, there is no need for increasing the forming roll diameter in order to ensure axial bending rigidity of the forming roll. As a result, it is possible to reduce the size of the apparatus.

Even when the forming roll diameter is reduced, the forming roll is difficult to bend, making it possible to increase the forming pressure without sacrificing the processing accuracy of the rack teeth that are formed.

Since the forming roll diameter can be reduced, the area of contact between the forming roll and workpiece can also be reduced, thereby, increasing the pressing force per unit area, thus increasing the raising of the pressed portion per rolling cycle of the forming roll, reducing the processing time.

Furthermore, since two racks can be formed at a time, the processing capacity can be doubled.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Figure 9:
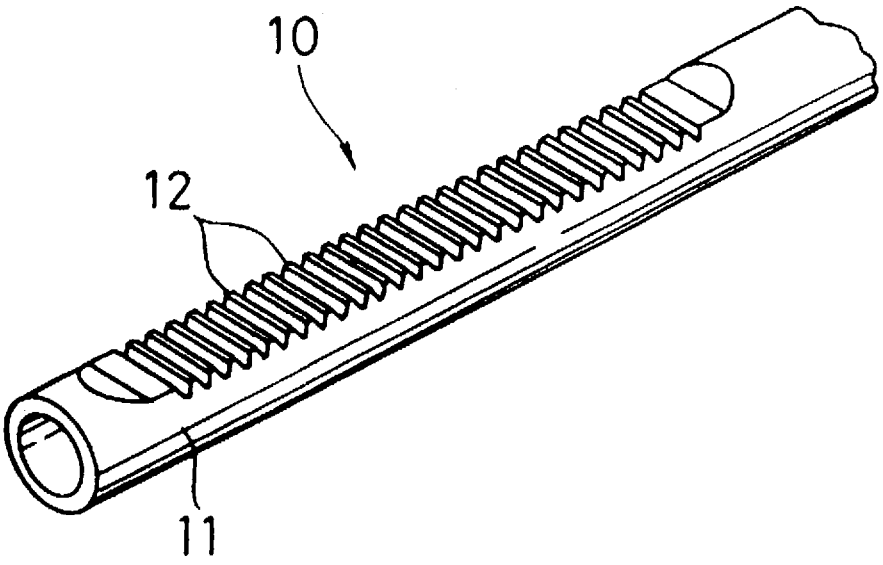
FIG. 9 is a schematic view showing a steering rack formed by the apparatus of the present invention.

According to the invention, a rack 10, as shown in FIG. 9, is obtained from a hollow round pipe which is used as rack material 11, and has a number of rack teeth 12 formed on a portion of the outer periphery of the material, traversing the axial direction of the rack material 11.

FIGS. 1 to 6 illustrate an apparatus for fabricating such rack 10. As shown, the apparatus 20 comprises a bed 21, a material clamp (i.e., material holding means) 22, a core bar setter 23, a material drive (i.e., mutual moving means) 24 and a tooth depth adjuster (i.e., feeding means) 25. With a core bar 26 inserted in the rack material 11, mutual moving of the rack material 11 and forming roll 27 is caused in the tangential direction of the forming roll 27, thus forming the rack material 11 with rack teeth. The forming roll 27 has its outer periphery provided with a rack of complementary teeth to teeth 12.

The material clamp 22 includes an angle adjuster (i.e., angle adjusting means) 28 for varying the holding angle (i.e., processing angle) of the rack material 11 to the forming roll 27.

The bed 21, material clamp 22, core bar setter 23, material drive 24, tooth depth adjuster 25 and angle adjuster 28 will now be successively described in greater detail.

Figure 1:
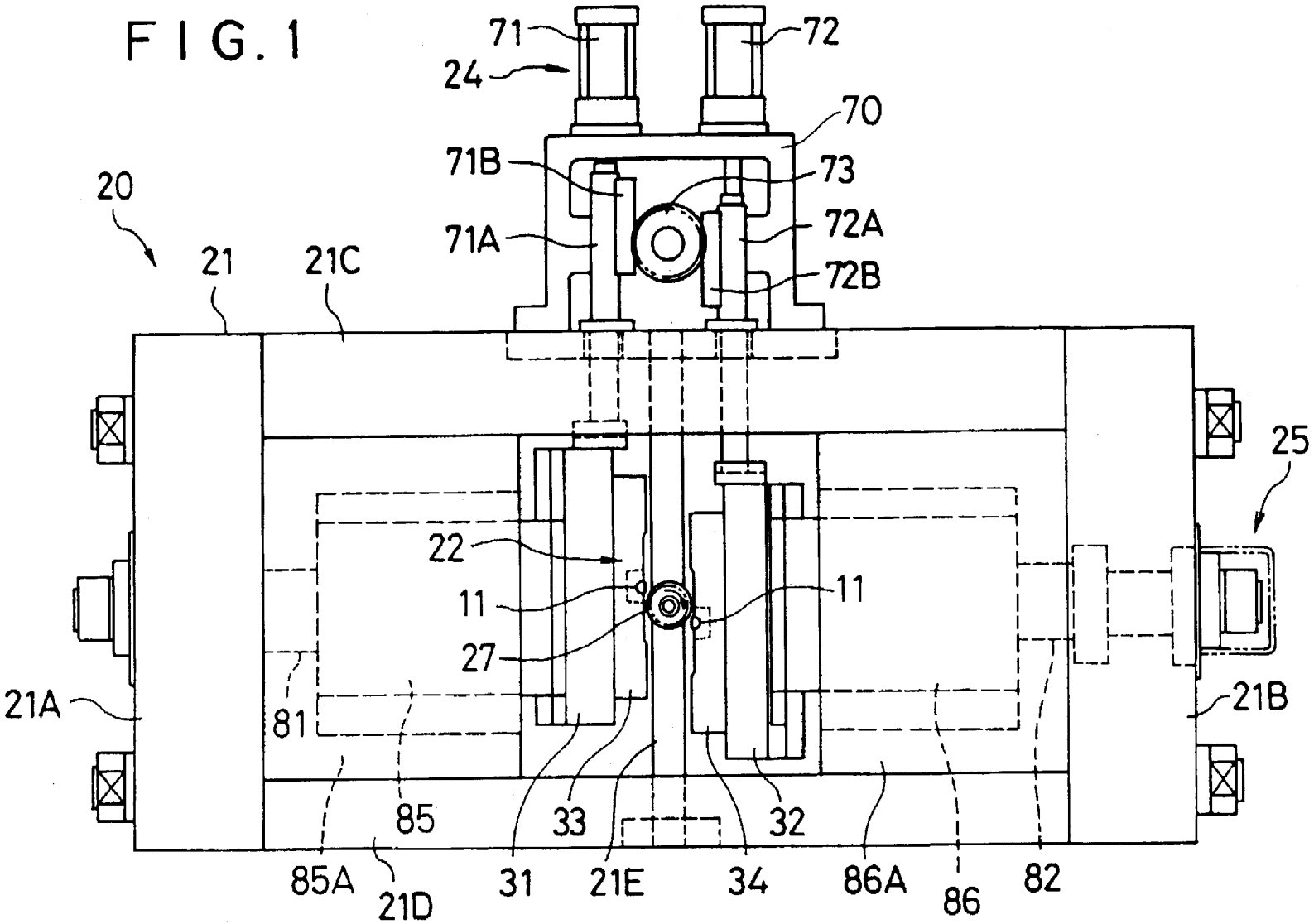
FIG. 1 is a front view showing an embodiment of the rack forming apparatus of the invention.
Figure 2:
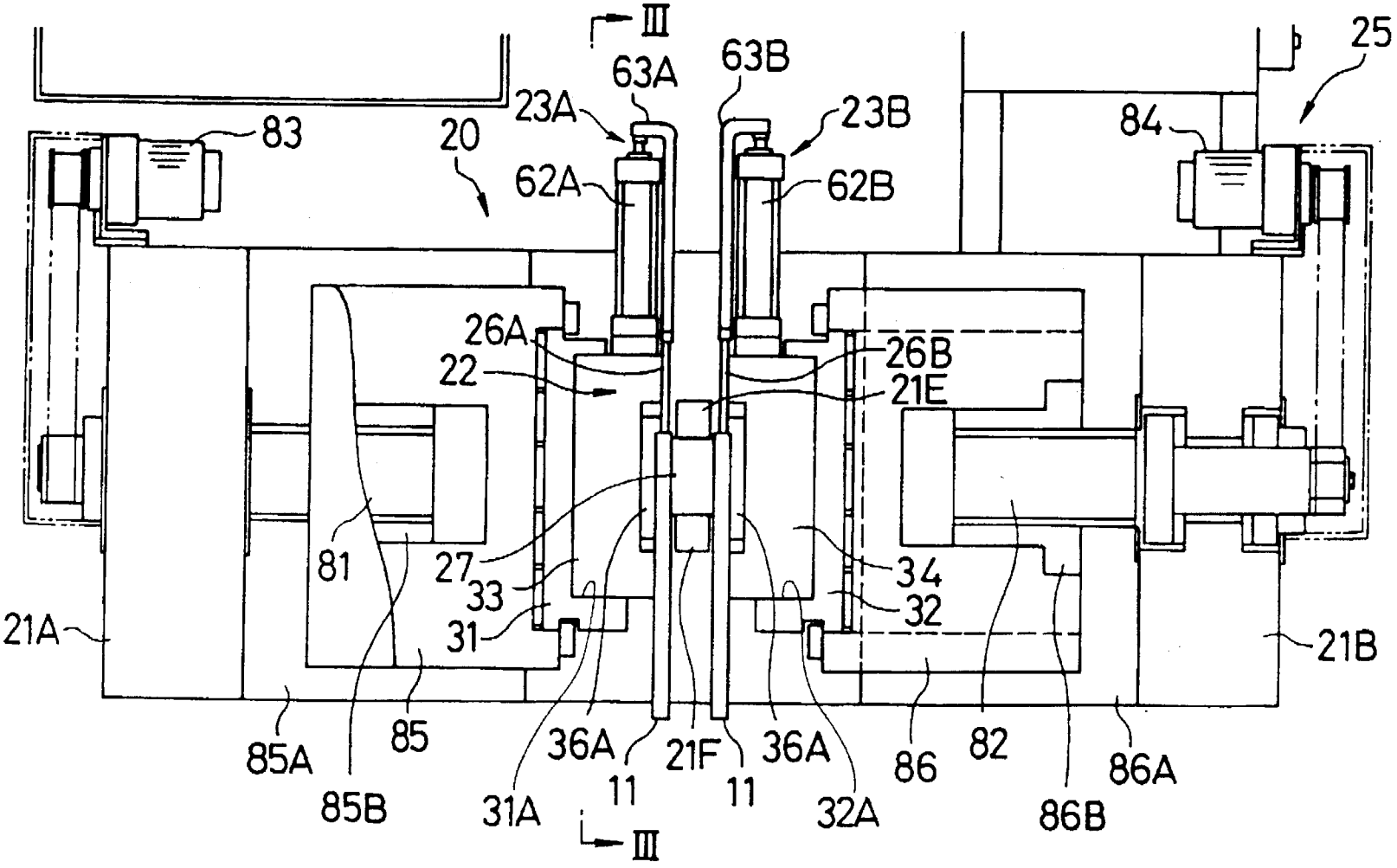
FIG. 2 is a plan view of FIG. 1.
Figure 3:
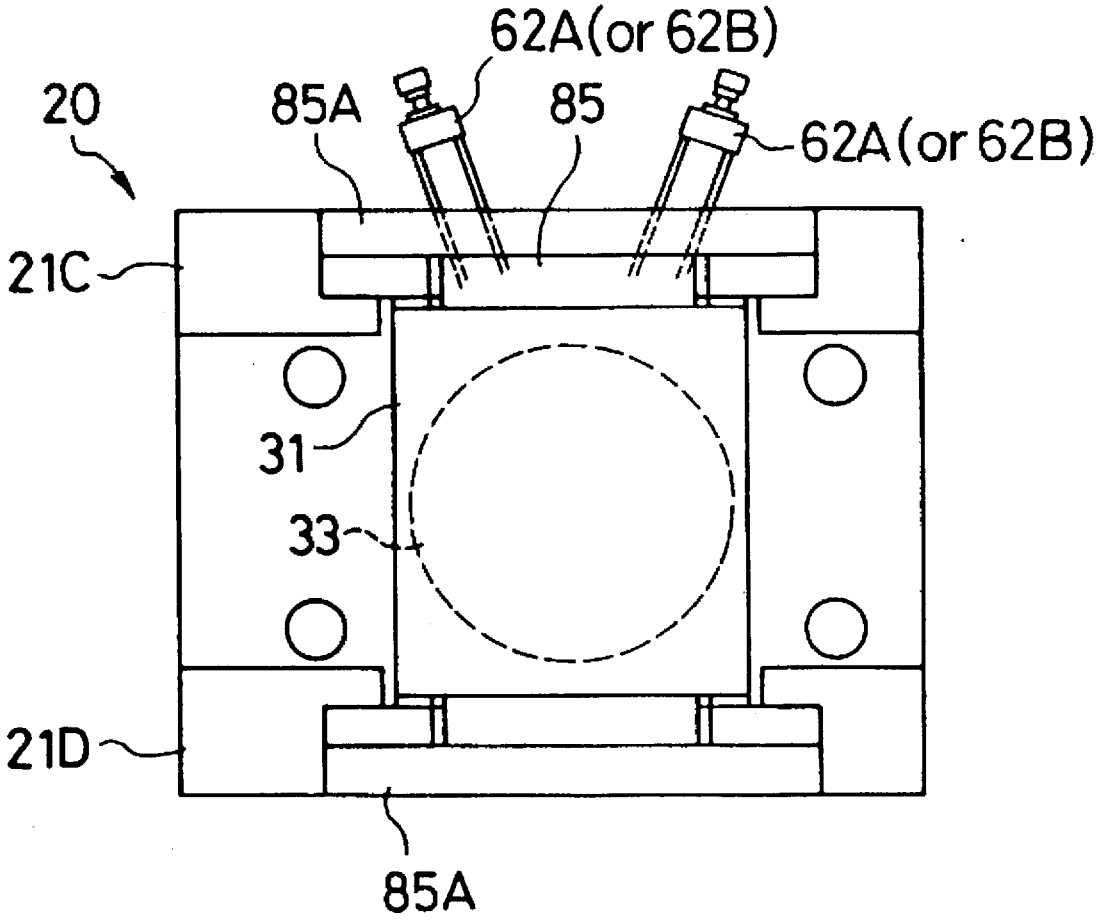
FIG. 3 is a view taken along line III—III in FIG. 2.

(A) Bed 21 (FIGS. 1 to 3)

The bed 21 has a left and a right side plate 21A and 21B and an upper and a lower plate 21C and 21D. The bed 21 further has a pair of support posts 21E and 21F which are provided between the upper and lower plates 21C and 21D. The forming roll 27 has its opposite shaft ends rotatably supported via bearings (not shown) on the two support posts 21E and 21F.

(B) Material clamp 22 (FIGS. 1 to 6)

Figure 4:
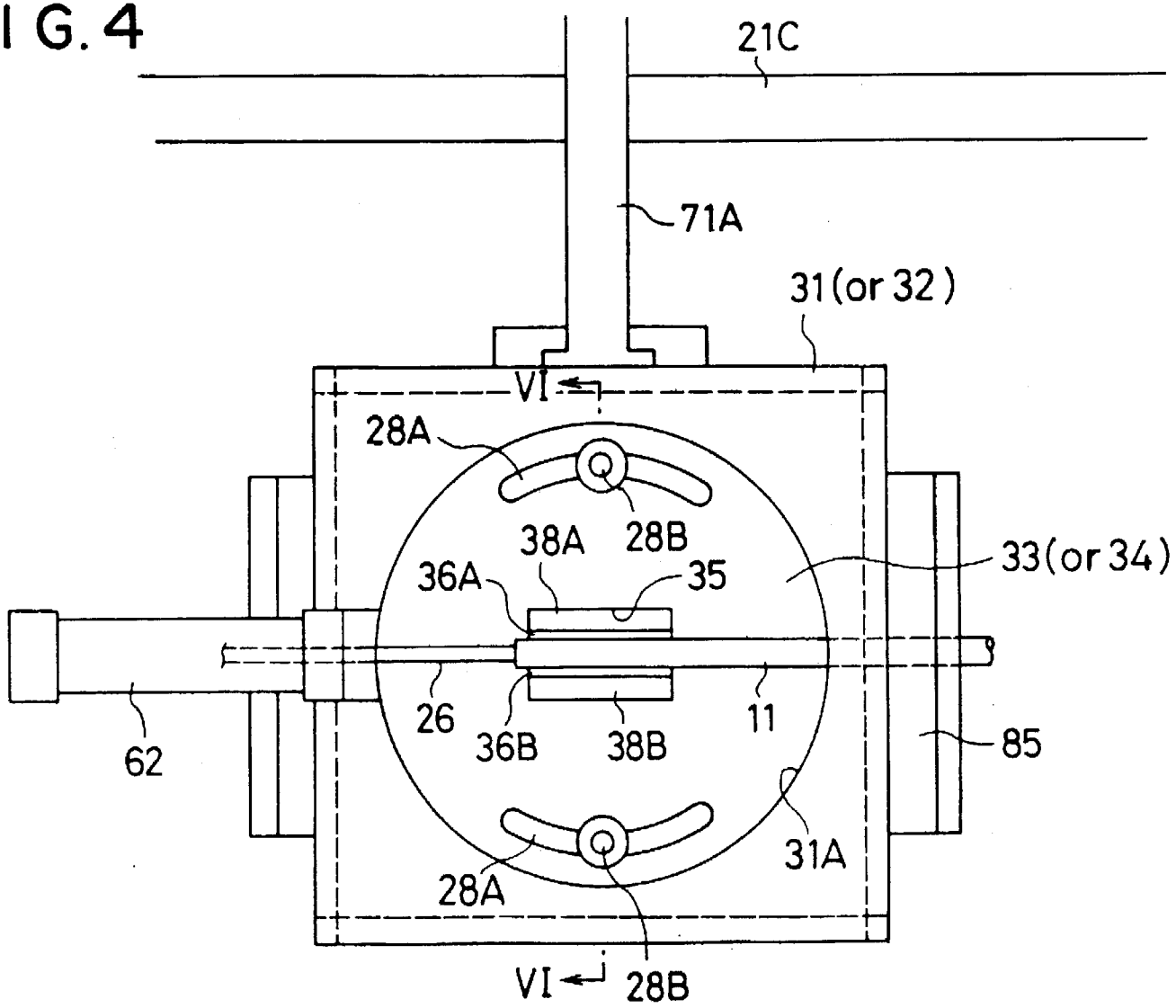
FIG. 4 is a schematic view showing the rack material holding means.

The material clamp 22, as shown in FIGS. 1 and 2, has a left and a right clamp housing 31 and 32, which are provided on diametrically opposite sides of the forming roll 27 such that they are in point symmetry on a point on the roll shaft axis of the forming roll 27. The left and right clamp housings 31 and 32, as shown in FIGS. 1, 2 and 4, are secured by set bolts 28B to the left and right clamp holders 33 and 34.

Figure 5:
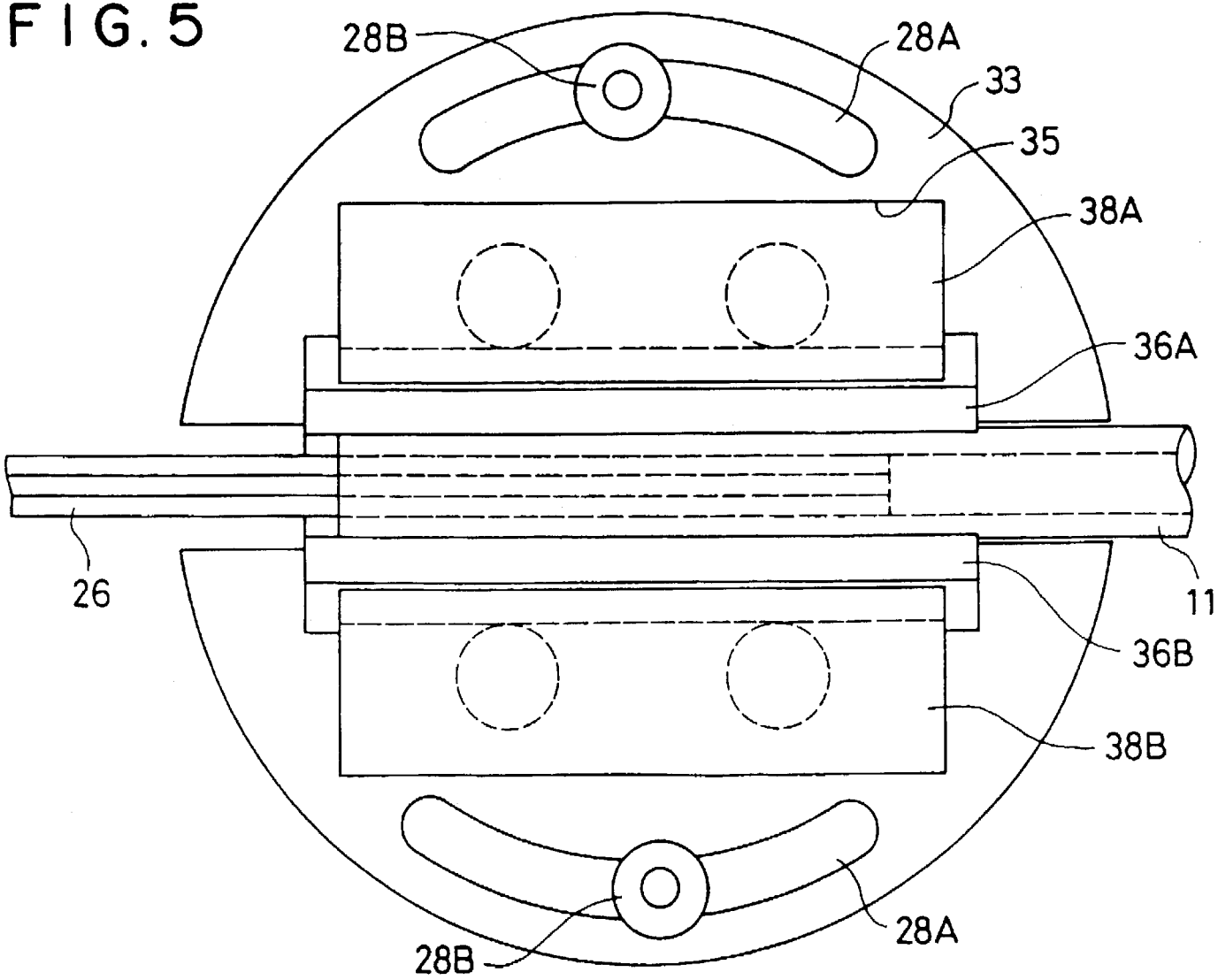
FIG. 5 is a detailed schematic view of an essential part shown in FIG.

The left and right clamp holders 33 and 34, as shown in FIGS. 5 and 6, each has a recess 35, in which upper and lower clamp members 36A and 36B are disposed for holding a rack material 11 therebetween. The upper and lower clamp members 36A and 36B are vertically movable in the recess 35 in each of the clamp holders 33 and 34. An opening spring 37 is provided between the clamp members 36A and 36B. Pair clamp cams 38A and 38B are provided on the outer side of the clamp members 36A and 36B. The clamp holders 33 and 34 each have oil hydraulic operating chambers 41A and 41B for plungers 39A and 39B which are screwed in the clamp cams 38A and 38B. The oil hydraulic operating chambers 41A and 41B each have a first and a second chamber 42 and 43 which are formed on the opposite sides of each of the plungers 39A and 39B. The two first chambers 42, 42 are communicated with each other by a duct line 44, and the two second chambers 43, 43 are communicated with each other by a duct line 45.

Figure 6A:
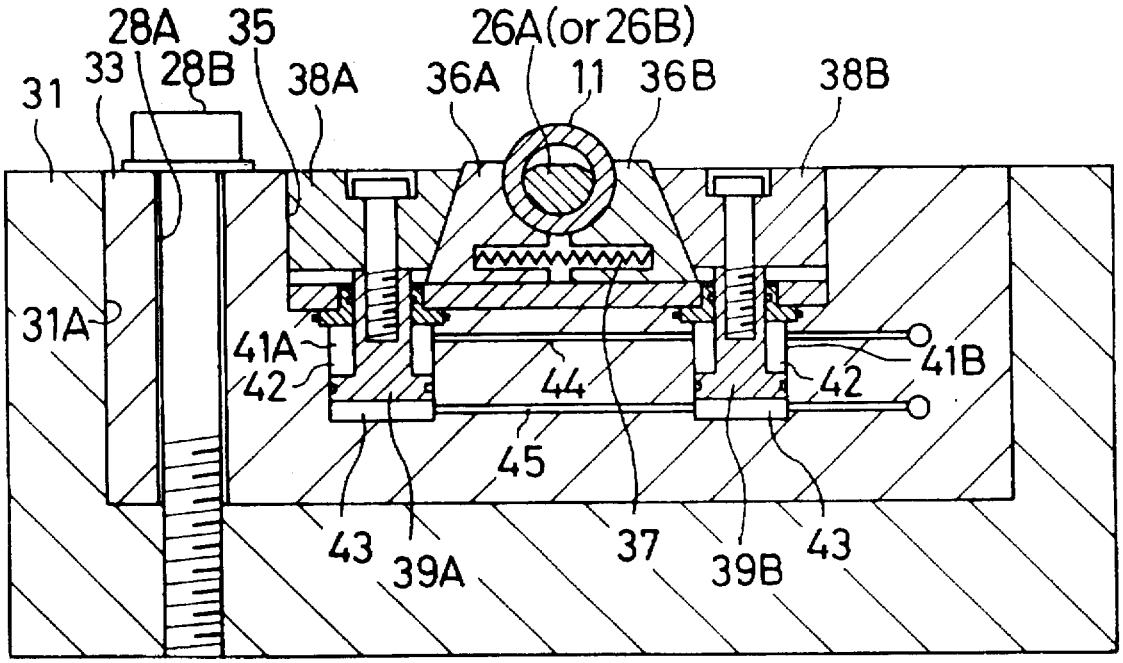
FIG. 6A is a sectional view taken along line VI—VI in FIG. 4.

Thus, for each of the left and right clamp holders 33 and 34, a lowering of clamp cams 38A and 38B will cause oil hydraulic operating fluid to be supplied to the oil hydraulic operating chambers 41A and 41B (FIG. 6A), wherein the clamp members 36A and 36B are closed together to hold the rack material 11. Thus, a separate rack material 11 is held by a respective left and right clamp holder 33 or 34, which are in a face-to-face relationship on diametrically opposite sides of the forming roll 27, in point symmetry arrangement, ready to start the rack forming process. When the rack forming process on each of the rack materials 11 is over, operationally, each of the left and right clamp holders 33 and 34, has hydraulic operating fluid supplied to the respective second chambers 43, 43 from the oil hydraulic operating chambers 41A and 41B, causing raising of the clamp cams 38A and 38B (FIG. 6A). Thus, the clamp members 36A and 36B are opened apart by the spring force of the spring 37, thus releasing the rack material 11 from each holder 33, 34.

Figure 6B:
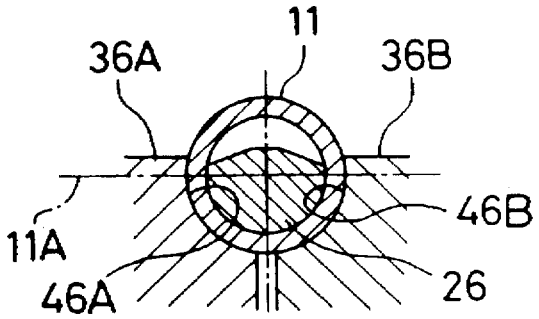
FIG. 6B is a detailed view showing a part shown in FIG. 6A.

The clamp members 36A and 36B, as shown in FIGS. 6A and 6B, each have a respective lower surface clamp portion 46A, 46B. Each lower surface clamp portion extends over the entirety of each respective clamp 36A and 36B in the longitudinal direction thereof and has a shape substantially complementary to the pipe-like rack material 11 so that it can clamp all of the lower half and a small portion above the equator 11A of the rack material 11.

(C) Core bar setter 23 (FIGS. 2 and 4)

Each core bar setter 23A, 23B, has a respective core bar cylinder 62A, 62B provided on a rear surface of the left and right clamp holders 33 and 34. Each core bar cylinder 62A, 62B has a respective rod 26A, 26B, to which a core bar mounting bracket 63A, 63B is secured. Each core bar 26A, 26B noted above is mounted on its respective core bar mounting bracket 63A, 63B.

Thus, with advancement of each core bar mounting bracket 63A, 63B by the respective core bar cylinder 62A, 62B, each core bar 26A, 26B is set in a material insertion position between the clamp members 36A and 36B. Now, the apparatus 20 is ready to start the rack forming process on each rack material 11, 11 with the respective core bar 26A, 26B inserted therein. When the rack forming process on the respective rack material 11, 11 is over, the respective core bar cylinder 62A, 62B causes retreat of the respective core bar mounting bracket 63A, 63B. As a result, each core bar 26A, 26B is removed from the respective rack material 11, 11.

In this embodiment, the core bar is set to a predetermined position for every process. However, it is possible to have the core bar secured at a predetermined position.

(D) Material drive 24 (FIGS. 1, 2 and 4)

The material drive 24 has a base 70 secured to the upper plate 21C of the bed 21. The base 70 supports a left and a right material reciprocating cylinder 71 and 72. The left clamp housing 31 is coupled via a left coupling shaft 71A to the rod of the left material reciprocating cylinder 71, and the right clamp housing 32 is coupled via a right coupling shaft 72A to the rod of the right material reciprocating cylinder 72. The left and right coupling shafts 71A and 72A have respective racks 71B and 72B, between which a pinion 73 is provided. The left and right coupling shafts 71A and 72A are driven in synchronism to each other and in opposite directions. The pinion 73 is supported on the base 70.

Thus, by synchronizing the lowering or raising of the left coupling shaft 71A by operation of the left material reciprocating cylinder 71 with the raising or lowering of the right coupling shaft 72A by operation of the right material reciprocating cylinder 72, the material 11 held in each of the respective clamp holders 33 and 34 of the left and right clamp housings 31 and 32, is moved in opposite directions while being simultaneously forced in contact with diametrically opposite side surfaces of the forming roll 27, thus the rack material is caused to move over the forming roll in the tangential direction thereto. At this time, the forming roll 27 is rotated in the counterclockwise or clockwise direction. The left and right rack materials 11 are caused to roll in opposite directions as noted above. It should be clear that when raising the left coupling shaft 71A, the right coupling shaft 72A will be lowered to cause counterclockwise direction of the forming roll 27.

(E) Tooth depth adjuster 25 (FIGS. 1 and 2)

The tooth depth adjuster 25 has a left and a right threaded shaft 81 and 82, which are rotatably supported on the left and right side plates 21A and 21B of the bed 21. The threaded shafts 81 and 82 can be driven by motors 83 and 84. Further, the bed 21 has a left and a right slide base 85A and 86A which slidably support a left and a right transversally slidable base 85 and 86. The left and right transversally movable bases 85 and 86 have nuts 85B and 86B in which the left and right threaded shafts 81 and 82 are screwed, respectively. The left transversal slidable base 85 supports the left clamp housing 31 to be integral with respect to the leftward and rightward directions, i.e., with respect to the tooth depth direction, and be capable of relative movement in the vertical directions along the axial direction of the left coupling shaft 71A. The right transversal slidable base 86 supports the right clamp housing 32 to be integral with respect to the leftward and rightward direction, i.e., with respect to the tooth depth direction, and to be capable of relative movement in the vertical direction along the axial direction of the right coupling shaft 72A. The left transversal slidable base 85 and left clamp housing 31, and the right transversal slidable base 86 and right clamp housing 32, are coupled to each other by engagement of a groove and a protuberance for movement only in the one direction noted above.

The tooth depth adjuster 25 references off the cycle of motion of the material reciprocating cylinders 71 and 72 for the control of motors 83 and 84, which in turn cause rotation of the left and right threaded shafts 81 and 82 by a predetermined angle for every cycle of reciprocal motion of the left and right rack materials 11 caused by the material drive 24. Thus, the left and right transversal sliding bases 85 and 86 will simultaneously advance towards the forming roll 27 in units of constant extent. The advancement of the left and right transversal sliding bases 85 and 86 is caused in synchronism to the vertical movement of the left and right clamp housings 31 and 32 with respect to the forming roll 27. Thus, in every moving cycle of the left and right rack materials 11 relative to the forming roll 27, the inter-axis distance between each of the left and right rack materials 11 and the forming roll 27 is reduced, thus gradually increasing the depth of the rack teeth 12 formed in the left and right rack materials 11.

(F) Angle adjuster 28 (FIGS. 4 and 5)

Figure 8:
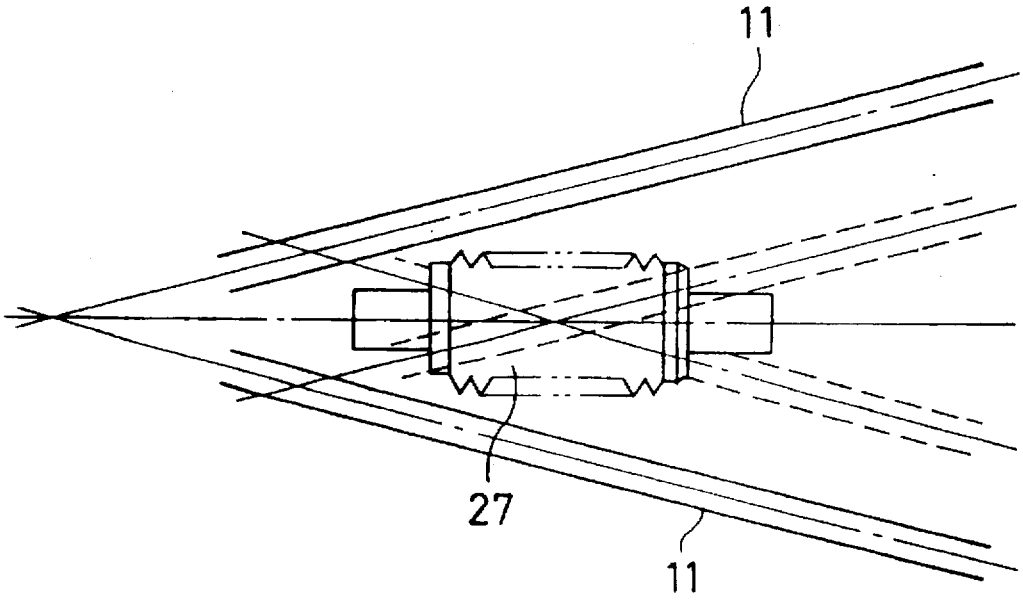
FIG. 8 is a schematic view showing the processing position of the rack material relative to the forming roll.

The angle adjuster 28 has clamp holders 33 and 34 supported for revolution on the left and right clamp housings 31 and 32 of the material clamp 22. The clamp holders 33 and 34 are circular and fitted in revolution guide holes 31A and 32A (FIG. 2) provided in the clamp housings 31 and 32, and each clamp holder 33 and 34 has a circular arc shaped long hole 28A at both sides of the recess 35 provided the clamp members 36A and 36B and the clamp cams 38A and 38B. They are secured by set bolts 28B to the clamp housings 31 and 32 at a predetermined position of revolution in the revolution guide holes 31A and 32A. Thus, each rack material 11 will be held in the material clamp 22, and as shown in FIG. 8, each rack material will be tilted a predetermined angle with respect to the axial direction of the forming roll 27, so that the rack 10 may have rack teeth 12 at an angle to the axial direction of the rack material 11.

Figure 7A:
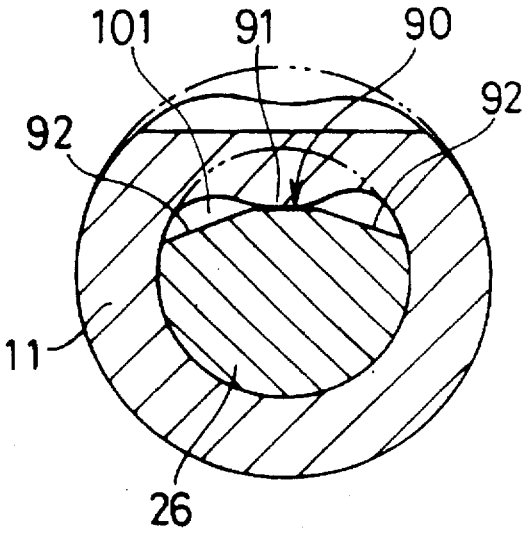
FIGS. 7A and 7B are sectional views of a core bar.
Figure 7B:
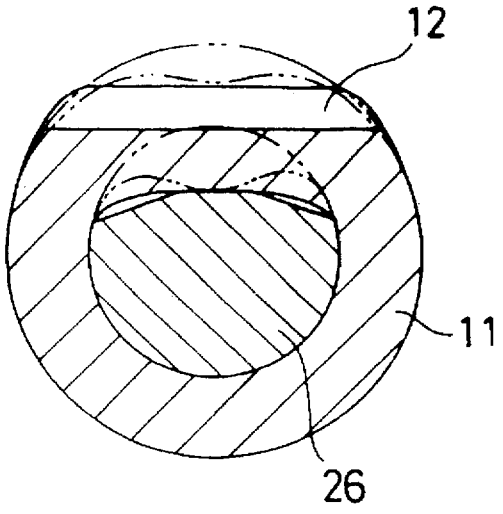

In the apparatus of rack manufacture 20, the sectional profile of the core bar 26, as shown in FIG. 7A, has a material support surface 90 which is spaced apart from a rack teeth forming portion of the rack material 11, the material support surface 90 being raised. Suitably, the material support surface 90 is formed by a central flat surface 91 and opposite side taper surfaces 92, 92. The resistance to deformation caused by the core bar 26 to the inner surface of the boundary portion between the flat surface, on which the rack teeth 12 of the rack material 11 are formed, and the periphery is little (since the clearance 101 is formed between the inner surface of the boundary portion of the rack material 11 and the material support surface 90 of the core bar 26). Then, the flat surface of the rack material 11 can be smoothly flatly deformed by pressing force of the forming roll 27 and no depression is formed on the rack teeth formation portion of the rack material 11 (FIG. 7B). Therefore, the depth of the rack teeth 12 becomes uniform in the tooth width direction.

The procedure of manufacture of rack 10 with the apparatus 20 of rack manufacture will now be described.

With the respective core bar setter 23A, 23B, a core bar 26A, 26B is set in the material insertion position between the clamp members 36A and 36B in each of the left and right clamp holders 33 and 34.

A left and right rack material 11 is set in the material insertion position between the clamp members 36A and 36B of each of the left and right clamp holders 33 and 34. At this time, the core bar 26 is then inserted inside the rack material 11, and each rack material 11 is then positioned in its holding position in the longitudinal direction by causing its end face to strike a respective stopper provided on each of the clamp holders 33 and 34.

With the material clamp 22, the left and right rack materials 11 are each clamped between the clamp members 36A and 36B of each of the left and right clamp holders 33 and 34. The left and right rack materials 11 are held face-to-face on diametrically opposed sides of the forming roll 27 such that they are in point symmetry with respect to a point on the roll shaft axis of the forming roll 27.

The left and right transversal sliding bases 85 and 86 of the tooth depth adjuster 25 are set in a suitable advanced position with respect to the forming roll 27. Then, with the material drive 24, the left and right clamp holders 33 and 34 are moved vertically. Thus, the materials 11 held clamped into the left and right clamp holders 33 and 34 are wedged into the outer periphery of the forming roll 27 while the inside of the pipe is supported by the material support surface 90 of the core bar 26. In this way, shallow rack teeth 12 are formed by cold processing on each of the left and right rack materials 11 as they move over the outer periphery of the forming roll 27 in opposite directions, while in point symmetry relationship with respect to a point on the roll shaft axis of the forming roll 27.

After that, in every sliding cycle of the left and right rack materials 11 relative to the forming roll 27, the left and right transversal sliding bases 85 and 86 are advanced towards the forming roll 27 in units of constant extent by the tooth depth adjuster 25. Thus, the inter-axis distance between each of the left and right rack materials 11 and the forming roll 27 is reduced, thereby gradually increasing the depth of the rack teeth 12 until the rack teeth 12 of predetermined depth can be formed.

This embodiment as described above has the following advantageous effects.

According to the invention, rack teeth 12 can be formed in a rack material 11 with the material drive 24 causing mutual moving of the rack material 11 and forming roll 27 in the tangential direction of the forming roll 27. At this time, since the forming roll 27 is pressed against the rack material 11 but the rack material 11 is caused to move over the forming roll 27 in the tangential direction thereof, the forming roll 27 is rotated by the tangential force caused while wedging the rack material 11 therein to form the rack teeth 12.

This means that there is no need for the step of first forming a flat teeth forming surface on the rack material 11, rather, it is possible to form rack teeth 12 directly into the round pipe. The process is simplified, thereby improving productivity.

The inter-axis distance between the forming roll 27 and rack material 11 can be reduced by the teeth depth adjuster 25 for every predetermined number of cycles (for instance every cycle) of mutual moving of the forming roll 27 and rack material 11. Thus, the forming roll 27 wedges incrementally into the material 11 for every predetermined number of cycles of the mutual moving, making it possible to form rack teeth 12 without requiring high forces at each pass, but rather can be done with comparatively low forces. Further, the rack teeth 12 thus formed are free from burrs which form when using high forces, and it is possible to form rack teeth 12 having excellent mechanical strength.

Since the material clamp 22 includes angle adjuster 28 for varying the holding angle of the rack material 11 against the forming roll 27, the rack material 11 may be provided with rack teeth 12 at right angles to the axial direction of the rack material 11, or it may be provided with rack teeth 12 at an angle to the axial direction of the rack material 11.

With the rack materials 11 being disposed face to face on diametrically opposite sides of the forming roll 27 since they move in opposite directions, the pressing forces exerted to the forming roll 27 by each of the rack materials 11 cancels each other due to the point symmetry with respect to a point on the roll shaft axis of the forming roll. It is thus unnecessary to increase the forming roll diameter so as to ensure the bending rigidity of the forming roll 27, thereby permitting size reduction of the apparatus 20.

Even with reduction of the forming roll diameter, it is difficult to bend the roll shaft of the forming roll 27, thus it is possible to increase the forming pressure without sacrificing the rack teeth processing accuracy.

Since the forming roll diameter can be reduced, the area of contact between the forming roll 27 and workpiece can be reduced to increase the pressing force per unit area. Consequently, the raising of the workpiece per moving cycle of the forming roll 27 can be increased to reduce the processing time. Since two racks can be formed at a time, the processing capacity can be doubled.

While the embodiment of the invention has been described in detail with reference to the drawings, the specific structure of the invention is by no means limited to the embodiment, but changes and modifications may be made without departing from the scope of the invention. For example, the tooth depth adjuster may reduce the inter-axis distance between the forming roll and rack material for every half cycle or every plurality of cycles (i.e., every predetermined rolling cycle) of reciprocal movement of the rack material.

Further, the mutual moving means does not have to be based only on the material drive 24, making it possible to move the forming roll with a forming roll drive.

While the preferred embodiments of the invention have been described in detail with reference to the drawings, they are by no means limiting, and it should be understood that various changes and modifications are possible without departing from the scope and spirit of the invention, which is set out in the following claims.

What is claimed is:

1. An apparatus for manufacturing an automobile steering rack having rack teeth formed on a side surface, comprising:

a rack material holding means for holding at least one hollow pipe-like rack material having a core bar inserted therein, said holding means having a vertical axis;

a forming roll having a vertical axis and an outer periphery, said forming roll periphery formed with a rack teeth form;

a mutual moving means for causing mutual moving of the rack material holding means and the forming roll, said holding means arranged and constructed to move in a tangential direction to an orientation of the forming roll as said rack material and said forming roll contact each other during formation of said steering rack;

a feeding means for adjusting a distance between the rack material holding means axis and the forming roll axis; and the rack material holding means arranged and constructed to hold two rack materials, each of said racks disposed face-to-face with respect to each other on diametrically opposed sides of the forming roll, wherein the mutual moving means causes moving of the individual rack materials in opposite directions with respect to each other, such that contact forces exerted by the rack material on the forming roll cancel each other along each point of symmetry on the roll axis.

2. The apparatus for rack manufacture according to claim 1, wherein the rack material holding means includes an angle adjusting means for varying a holding angle of the rack material against the forming roll.

* * * * *